US006170945B1

(12) United States Patent
Matsui et al.

(10) Patent No.: US 6,170,945 B1
(45) Date of Patent: Jan. 9, 2001

(54) INK JET RECORDING APPARATUS WITH CARTRIDGE STORAGE

(75) Inventors: Shinya Matsui; Toshimitsu Hirakue, both of Tokyo; Masakazu Ozawa, Ebina; Junichi Asano, Kawasaki; Masanori Morita, Toyko; Eiichi Motai, Yokohama; Tetsuto Kageyama, Koshigaya; Yasuyuki Ishii, Kawasaki, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 08/901,958

(22) Filed: Jul. 29, 1997

Related U.S. Application Data

(63) Continuation of application No. 08/567,800, filed on Dec. 6, 1995, now abandoned, and a continuation of application No. 08/110,973, filed on Aug. 24, 1993, now abandoned.

(30) Foreign Application Priority Data

Aug. 25, 1992 (JP) ..... 4-248569
Jan. 14, 1993 (JP) ..... 5-004738

(51) Int. Cl.[7] ..... B41J 29/13
(52) U.S. Cl. ..... 347/108
(58) Field of Search ..... 347/85, 86, 87, 347/108, 29; 400/171

(56) References Cited

U.S. PATENT DOCUMENTS

| | | | | |
|---|---|---|---|---|
| 4,543,589 | * | 9/1985 | Terasawa | 346/140 R |
| 4,623,905 | * | 11/1986 | Ichihashi et al. | 347/86 |
| 5,018,884 | * | 5/1991 | Hirano et al. | 400/171 X |
| 5,153,613 | | 10/1992 | Yamaguchi et al. | 346/140 R |
| 5,231,416 | | 7/1993 | Terasawa et al. | 346/140 |

FOREIGN PATENT DOCUMENTS

| | | | | |
|---|---|---|---|---|
| 91678 | * | 7/1980 | (JP) | 347/87 |
| 58-7362 | * | 1/1983 | (JP) | 347/29 |
| 106257 | * | 5/1986 | (JP) | 347/108 |
| 61-093265 | | 6/1986 | (JP) . | |
| 141423 | * | 5/1992 | (JP) | 347/87 |

* cited by examiner

*Primary Examiner*—N. Le
*Assistant Examiner*—Michael Nghiem
(74) *Attorney, Agent, or Firm*—Fitzpatrick, Cella, Harper & Scinto

(57) ABSTRACT

An ink jet recording apparatus includes a recording head for effecting recording by ejecting ink onto a recording material and a holder for holding the recording head while it is not used for recording. The holder includes a cap for sealing an ejection outlet of the recording head, and the cap includes ink absorbing material for maintaining wetness of the ejection outlet.

24 Claims, 7 Drawing Sheets

INK JET RECORDING APPARATUS WITH CARTRIDGE STORAGE

This application is a continuation of application Ser. No. 08/567,800, filed Dec. 6, 1995 and a continuation of application Ser. No. 08/110,973, filed Aug. 24, 1993, both now abandoned.

FIELD OF THE INVENTION AND RELATED ART

The present invention relates to an ink jet recording apparatus provided with a space where a cartridge can be easily mounted or removed.

In a recording apparatus such as a printer, copying machine, facsimile machine, or the like, or a recording apparatus used as an output device for a multi-functional electronic apparatus such as a work station which includes a computer or a word processor, an image is recorded on a recording material (recording medium) such as a sheet of paper or thin plastic plate, or the like, based on image data. These recording apparatuses can be classified as ink jet type, wire dot type, thermal type, laser beam type, or the like, depending on their recording system.

In a serial type recording apparatus incorporating a serial scanning system in which the primary scanning direction is perpendicular to the direction (secondary direction) in which the recording material is conveyed, the image is recorded on the recording material aligned at a predetermined recording position, by a recording means (generally, being mounted on a carriage) which moves across (primary scanning) the recording material. After a line of image is completed, the recording material is advanced by a predetermined distance (recording material conveyance), and then, after the recording material stops, the next line of image is recorded (primary scanning). This cycle is repeated until recording is made over the entire surface of the recording material. On the other hand, in a line type recording apparatus in which only the recording material is moved, printing occurs simultaneous across the entire line while the recording material aligned at a predetermined starting position is continuously advanced (advanced at a given pitch) in the secondary scanning direction until the recording is made over the entire surface of the recording material.

Among the recording apparatuses listed above, the recording apparatus incorporating an ink jet recording system (ink jet recording apparatus), which records images by ejecting ink onto the recording material from a recording means (recording head), has various advantages, such that the size of the recording means can be easily reduced; highly precise images can be recorded at a high speed; images can be recorded on an ordinary untreated sheet of paper; operational cost is low; operating noise is low because it is of the non-impact type; and in addition, color recording can be easily made through the use of various color inks. With use of the line type recording means in which a large number of ejection orifices are aligned across the lateral printing range of the recording material, the speed at which the ink jet recording apparatus records images can be further increased.

In particular, the recording means (recording head) of the ink jet type which uses thermal energy to eject ink can be manufactured by semiconductor manufacturing processes, such as etching, deposition, sputtering, or the like, in which electro-thermal transducers, electrodes, walls of liquid passages, top plates or the like can be formed on substrate, and therefore, it is simple to realize a recording head in which the liquid passages (arrangement of ejection orifices) are arranged in high density, enabling the recording head size to be further reduced.

On the other hand, there are many conditions to be required of the properties of recording material. In recent years, it has become necessary to use extremely thin paper, fabricated paper (paper with holes punched out for filing, paper with perforations, paper having non-standard sizes or shapes), or the like, in addition to the ordinary paper, or thin resin sheet (used with an OHP or the like).

As for the available choices of recording means used in the ink jet recording apparatus, there are a permanent type and a detachable type. In the apparatus incorporating the permanent type recording means, a recording head having an extremely long service life is employed so that it is unnecessary in an ordinary situation to remove the recording head from the main assembly of the apparatus. On the other hand, in the case of the disposable type, the recording means is generally an exchangeable head cartridge in which a recording head and an ink container are integrated. When the ink within the head cartridge is depleted, the head cartridge is removed from the main assembly of the apparatus to be discarded, and a fresh head cartridge is installed.

It is also possible to use such an ink jet recording apparatus for recording color images. In this case, the ink consumption varies depending on colors, and therefore, the ink container capacity is varied according to the amount of the ink consumption; generally speaking, the capacity for the color consumed by the largest amount is increased and the capacities for other colors are reduced, whereby the overall apparatus size is reduced. Further, according to one of the proposals made for reducing the size or cost of the apparatus, during an ordinary recording operation, only a head cartridge for black color is mounted on a carriage, on which the recording means is mounted, and when necessary, this cartridge is exchanged with cartridges containing other colors.

However, such prior arrangements had the following inconveniences, since an unwanted head cartridge had to be removed from the recording apparatus in order to record the image using a wanted head cartridge. First, the partially used head cartridge removed from the recording apparatus had to be sometimes left out for a long time, during which it was likely for the liquid components of the ink to evaporate from the recording head, causing the ejection orifices to be clogged with the solidified ink. Secondly, when the partially used cartridge was left out, it was likely for the ink to leak out of the head cartridge depending on how it was laid down. Thirdly, it was likely for the surface of the partially used head cartridge, where the ejection orifices are arranged (ejection surface), to be damaged, or sometimes destroyed. Fourthly, while the partially used head cartridge was left out, it was likely for foreign matter to adhere to the ejection surface, whereby the ink could not be properly ejected when the cartridge was reused. Such inconveniences could be mostly eliminated by the structure disclosed in a Japanese Laid-Open Utility Model Application Ser. No. 93,265/1986, but there still is some room for improvement.

SUMMARY OF THE INVENTION

The present invention was made to improve further the invention disclosed in the aforementioned Japanese Laid-Open Utility Model Application No. 93,265/1986. The object of the present invention is to provide an ink jet recording apparatus capable of protecting surely the recording means while it is not used for recording, so that excellent images can be recorded when the protected recording means is reused.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
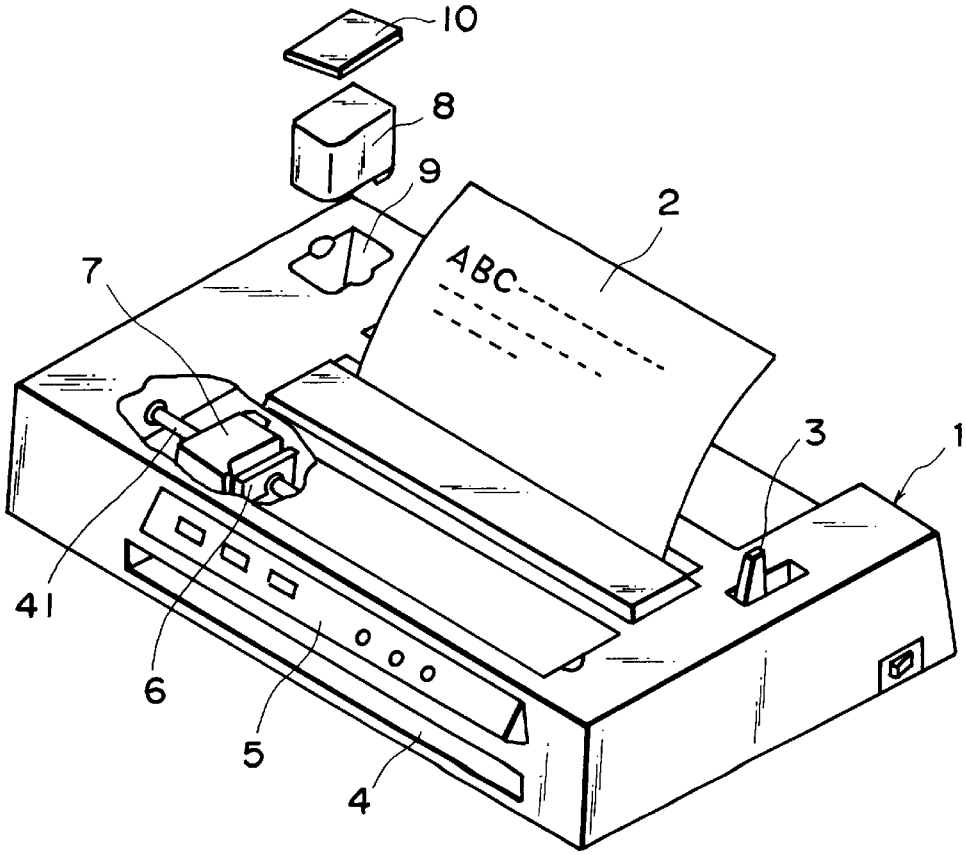
FIG. 1 is a schematic perspective view of a preferred embodiment of the ink jet recording apparatus in accordance with the present invention.

Hereinafter, the embodiments of the present invention will be described referring to the drawings.

FIG. 1 is a schematic perspective view of the preferred embodiment of the ink jet recording apparatus in accordance with the present invention. In FIG. 1, a reference numeral 1 designates an ink jet recording apparatus; 2, a recording material such as a sheet of printing paper or thin plastic plate on which an image is recorded; 3, a release lever for releasing a conveying roller (feed roller) or the like, to cancel the friction by which the recording material is conveyed; 4, an opening for feeding the recording material; 5, a control panel comprising switches or displays; 6, a carriage capable of shuttling laterally across the recording material 2, along a guide shaft 41 provided in the main assembly of the apparatus; 7, a head cartridge (first head cartridge) as the recording means mounted on the carriage 6, being used for actual recording; 8, a head cartridge in storage (second cartridge), not being used; 9, a storage space provided in the main assembly of the apparatus for storing the second head cartridge 8; and 10, a cover for sealing the storage space 9.

In the ink jet recording apparatus 1, as the carriage 6 is moved (primary scanning) by a motor (source of driving force), the first head cartridge 7 mounted on the carriage 6 is driven in response to recording signals, whereby images are recording on the recording material 2, by a predetermined width. The second head cartridge 8 which is not being used for the current recording is in the storage space 9.

Figure 2:
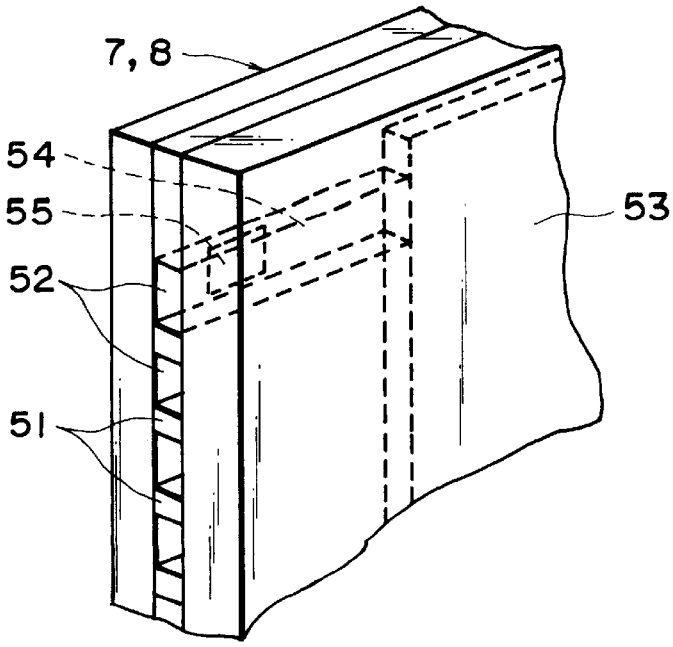
FIG. 2 is a schematic perspective view of a portion of an recording means, showing the structure of the portion where the ink is ejected.

FIG. 2 is a schematic perspective view of a portion of the recording means (recording head portion of the head cartridge 7 or 8), showing the structure of the portion where the ink is ejected. In the recording means (recording head portion of the head cartridge 7 or 8) shown in FIG. 2, a surface 51 where two or more ejection orifices 52 are arranged at a predetermined pitch faces the recording material 2, holding a predetermined gap (for example, 0.5 mm to 2.0 mm). Each ejection orifice 52 is connected to a common liquid chamber 53 through individual liquid passage 54 in which the electro-thermal transducer 55 (heat generating resistor or the like) is disposed on one of the walls to generate the ink ejection energy. In this embodiment, the recording means 7 or 8 is mounted on the carriage 6 to hold such a positional relation that the ejection orifices 52 are aligned in the direction perpendicular to the direction in which the carriage 6 is moved (primary scanning direction). With such an arrangement in place, the electro-thermal transducers 55 are driven (power is supplied) in response to imaging signals or ejection signals, to cause the film boiling of the ink in the liquid passages 54, and the pressure generated at this time is used to eject the ink from the ejection orifices 52.

The first head cartridge 7 and second head cartridge 8 may contain inks of different colors, but their structure and measurements are substantially the same. When the first head cartridge 7 is exchanged with the second head cartridge 8, first, the second head cartridge 8 is taken out of the storage space 9 of the main assembly of the apparatus by pushing an eject button or the like (unshown) and the first head cartridge 7 is removed from the carriage 6. Next, the second head cartridge 8 is mounted on the carriage 6, and the first head cartridge 7 is inserted into the storage space 9 to be covered as the cover 10 is installed. This cover 10 is provided for preventing foreign matter from entering the storage space 9, in consideration of possibility that the ejection failure or image shift may be caused by the foreign matter adhering to the ink ejecting portion of the head cartridge 7 or 8.

Figure 3:
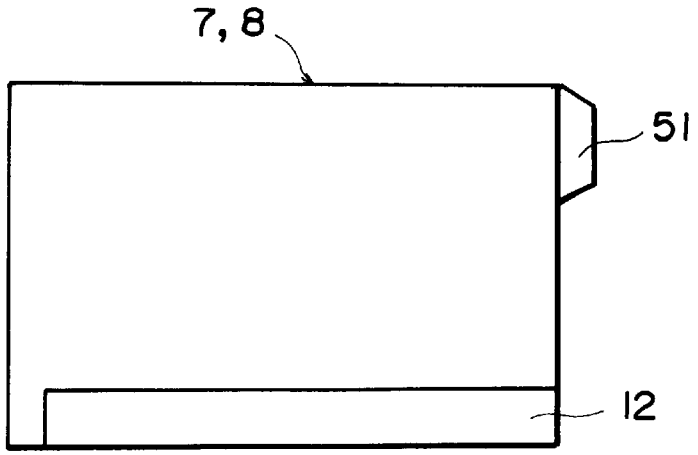
FIG. 3 is a plan view of the recording means.
Figure 4:
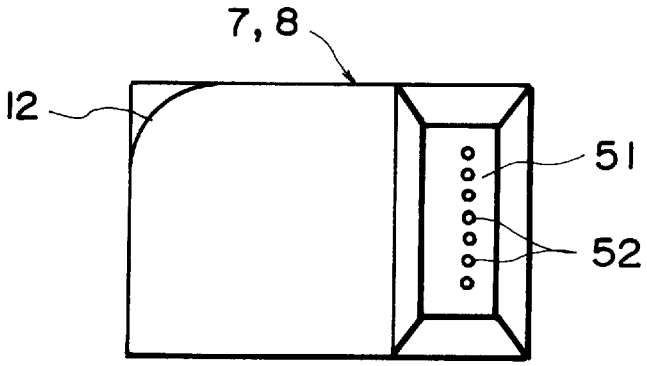
FIG. 4 is a plan view of the recording means.
Figure 5:
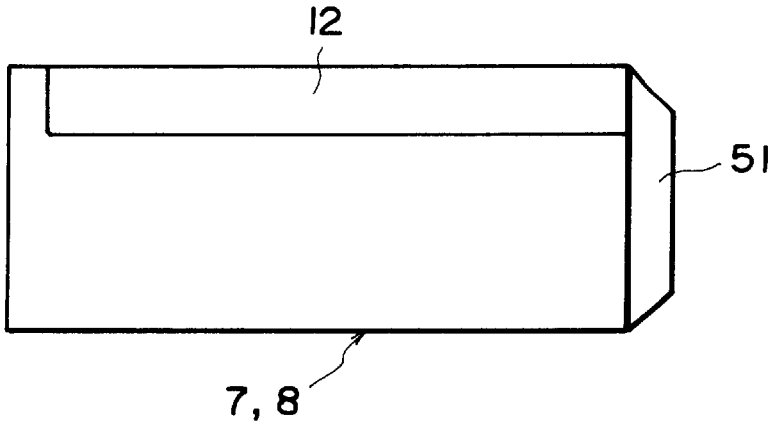
FIG. 5 is a right side view of the recording means.

FIGS. 3 to 5 are views of the head cartridge 7 or 8, wherein FIG. 3 is a plan view; FIG. 4, a front view; and FIG. 5 is a right side view, as when viewed being mounted on the carriage. Referring to FIGS. 3 to 5, the surface 51 on which two or more ejection orifices 52 are vertically aligned can be seen on the right side of the head cartridge 7 or 8, and a guide 12 (corner is cut out in this embodiment) for preventing positioning error (inserting error) when the head cartridge is inserted in the storage space 9 can be seen at the top left corner in FIG. 4.

Figure 6:
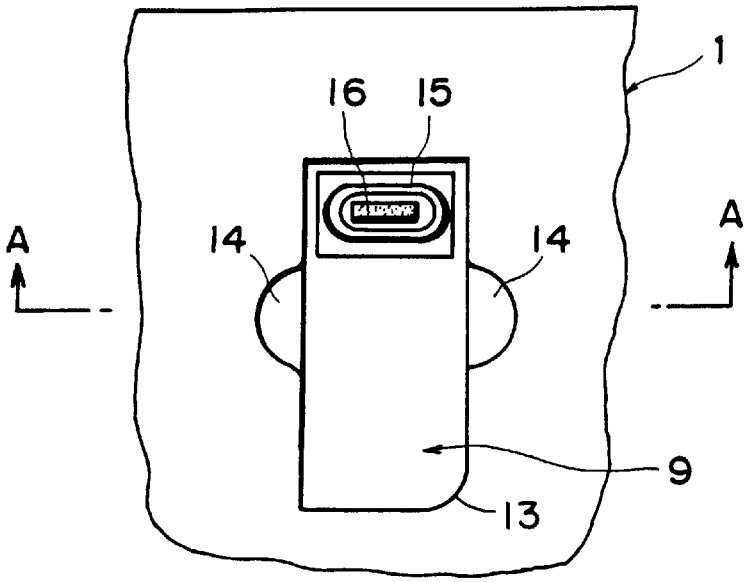
FIG. 6 is a plan view of a storage space which is disclosed when the recording means and a cover are removed from the apparatus shown in FIG. 1.
Figure 7:
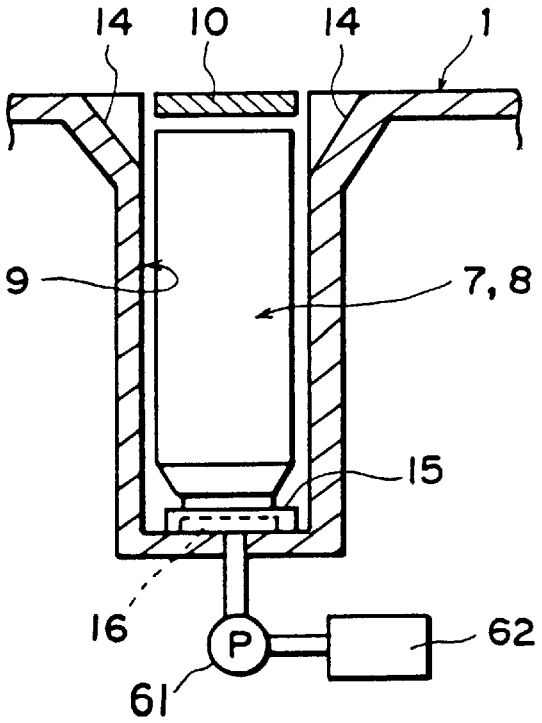
FIG. 7 is a longitudinal cross-sectional view, along a line A—A, of the portion shown in FIG. 6, being shown with the recording means and cover in place.

FIG. 6 is a plan view of the storage space 9, as seen with no head cartridge in it. FIG. 7 is a vertical sectional view, along a line A—A shown in FIG. 6, of the storage space 9, as seen with the head cartridge 7 or 8 in it and with the cover 10 on. The storage space 9 has substantially the same shape and measurements as the head cartridge 7 or 8, and the head cartridge 7 or 8 is inserted and stored there, with the ink ejecting portion (surface 51) facing downward. At the bottom left corner of the storage space 9, as seen in FIG. 6, a guide 13 is provided on the main assembly side, to correspond to the guide 12 of the head cartridge 7 or 8.

Two recesses 14 are provided at the lip of the storage space 9, in a manner to face each other so that the stored head cartridge 7 or 8 can be easily grasped to be taken out. At the bottom of the storage space 9, a cap 15 is disposed at a position correspondent to the ink ejecting portion (ejection orifices 52) of the inserted head cartridge 7 or 8, so that it comes in contact with the surface 51 to seal the ejection orifices 52 as the head cartridge 7 or 8 is inserted. Within the concave portion of this cap 15, an ink absorbing member 16 is provided for removing the ink adhering to the ejection surface 51 or for capturing the ink leaking out of the ejection orifices 52. The guide 12 provided on the head cartridge 7 or 8 and the guide 13 provided in the storage space 9 can prevent a user from inserting the head cartridge 7 or 8 in a wrong way, upside down or right to left.

Further, two caps 15 may be provided, each at a different location in the storage space 9. In this case, the ejection orifices 52 can be sealed by one of the caps 15 regardless of the inserting direction, eliminating the necessity for the guide in the storage space 9.

Further, the cap 15 may be provided with a pump 61 as shown in FIG. 7. Such provision of the pump 61 enables the performance recovery operation to be performed on the cartridge 7 or 8 while it is in the storage space 9, and therefore, the performance recovery operation which is usually carried out immediately after the cartridge 7 or 8 is re-mounted on the carriage, that is, a process in which the performance recovery means is driven, can be skipped, providing nevertheless an excellent printing condition.

The pump 61 is connected to a waste ink container 62, whereby the waste ink is sucked by the pump 61 to be discharged into the waste ink container 62. The waste ink container 62 is preferred to be partially open so that the ink discharged there can be evaporated into the atmosphere. In this embodiment, the pump 61 and waste ink container 62 may double as the pump and waste ink container which carry out the performance recovery operation for the head cartridge mounted on the carriage. When the performance recovery operation is needed, an operator can start the operation by a dedicated or multi-purpose switch provided on the control panel, or the switch for the performance recovery operation may be provided on the cap 10.

Figure 8:
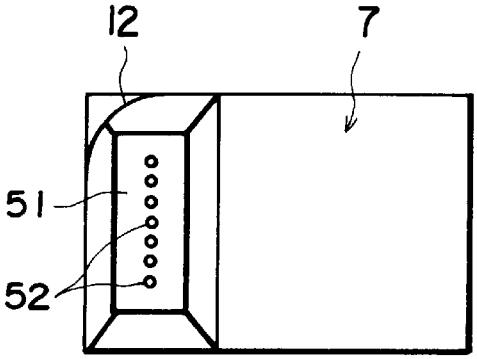
FIG. 8 is a front view of the first recording means incorporated in the second embodiment of the ink jet recording apparatus in accordance with the present invention.
Figure 10:
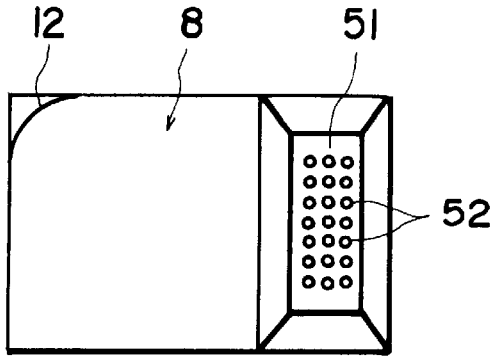
FIG. 10 is a plan view of the second recording means incorporated in the second embodiment of the ink jet recording apparatus in accordance with the present invention.
Figure 9:
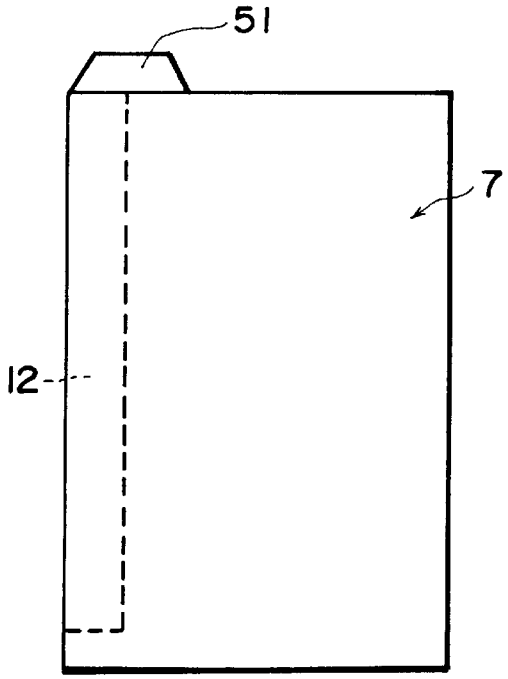
FIG. 9 is a plan view of the bottom of the recording apparatus.
Figure 11:
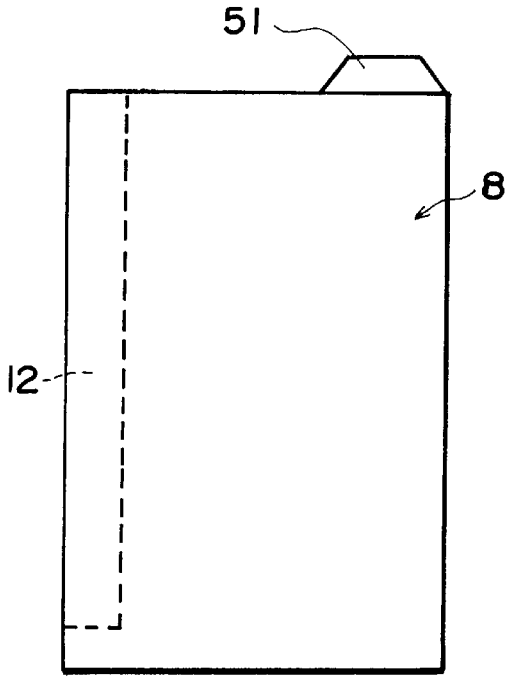
FIG. 11 is a plan view of the bottom of the recording means.

FIGS. 8 to 12 depict the second embodiments of the aforementioned head cartridge and storage space, in accordance with the present invention; FIG. 8 is a front view of the first head cartridge 7; FIG. 9, a plan view of the bottom of the first head cartridge 7; FIG. 10, a front view of the second head cartridge 8; FIG. 11, a plan view of the bottom of the second head cartridge 8; and FIGS. 12A and 12B are plan views of the storage space 9, showing two different structures, as seen with presence of no head cartridge and with the cover off. The first head cartridge 7 is a mono-color cartridge having a single line of the ejection orifices 52, and the second head cartridge 8 is a multi-color cartridge having two or more lines (for example, three lines) of the ejection orifices 52.

Figure 12A:
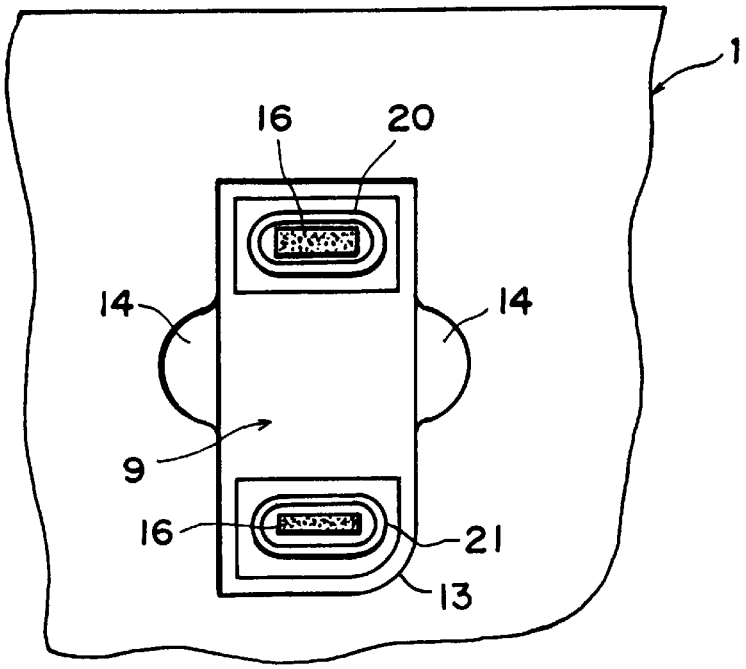
FIGS. 12A and 12B are plan views of the storage space for protecting the recording means in the second embodiment of the ink jet recording apparatus in accordance with the present invention, showing their structures.
Figure 12B:
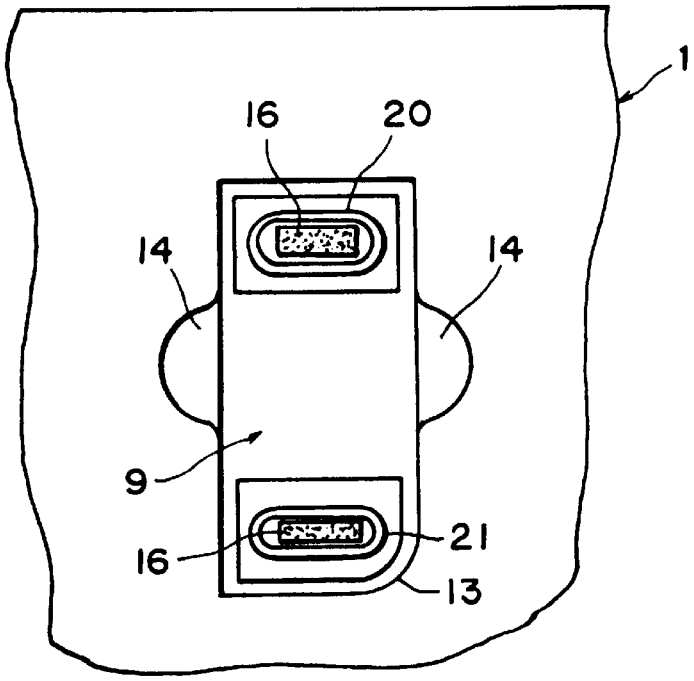

In FIGS. 8 to 11, where the ejection orifices 52 (or the surface 51 where the ejection orifices 52 are arranged) are located on the first head cartridge 7 is opposite to, or offset from, where the ejection orifices 52 (or the surface 51 where the ejection orifices 52 are arranged) are located on the second head cartridge 8, with reference to the guide 12. In FIGS. 12A and 12B, two caps are provided on the respective bottom surfaces of the storage spaces 9, a cap 20 at one location and a cap 21 at another location, with one of which corresponding to the single line of ejection orifices 52 of the first head cartridge 7 and the other of which corresponding to the three lines of ejection orifices 52 of the second head cartridge 8, so that two caps 20 and 21 come in contact with the respective ejection surfaces 51 to seal the ejection orifices 52 on the respective ejection surfaces 51. In other words, two caps 20 and 21 are provided in both structures (A) and (B). In the case of (A), the caps 20 and 21 are substantially of the same size and shape, but in the case of (B), the cap 21 for sealing the single line of ejection orifices 52 of the first head cartridge 7 is of a size and shape smaller than the cap 20 for sealing the multiple lines of ejection orifices 52 of the head cartridge 8. Also, in both cases (A) and (B), ink absorbing member 16 is provided in each of caps 20 and 21 for removing and capturing the ink or the like adhering to the ejection surface 51.

According to the structures shown in FIGS. 8 to 12, when the mono-color head cartridge 7 is not needed, it is inserted into the storage space 9, where its ejection orifices 52 are sealed and protected by the cap 21. On the other hand, when the multi-color head cartridge 8 is not required any more, it is inserted into the storage space 9, where its ejection orifices 52 are sealed and protected by the cap 20. Since the ejection surface 52 (ejection orifices 51) of the multi-color head cartridge 8 and mono-color head cartridge 7 are separately sealed and protected by different caps 20 and 21, the mixing of color inks between the head cartridges 7 and 8 is guaranteed not to occur. Further, if the cap is made narrower to cover the ejection orifices 52 and only the immediately adjacent area as shown by the cap 21 in FIG. 12B, the tolerance of the ink evaporation in the ejection orifices 52 can be improved. Also in this embodiment, the pump and the waste ink container may be provided, though not illustrated.

Figure 13:
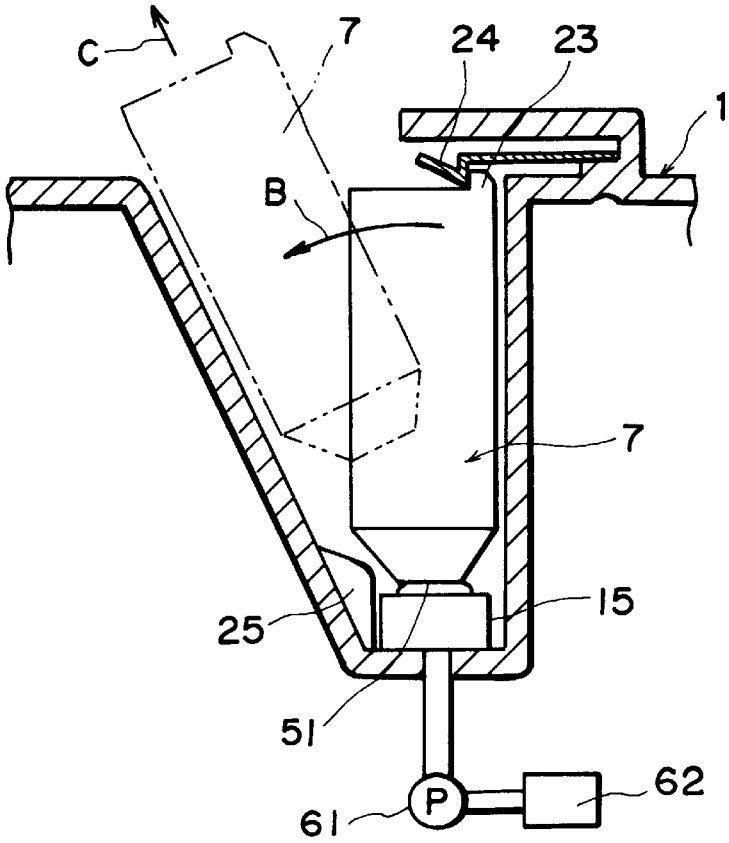
FIG. 13 is a sectional view of a preferred embodiment of a mechanism for receiving or releasing the recording means, provided in the storing means of the ink jet recording apparatus in accordance with the present invention.
Figure 14:
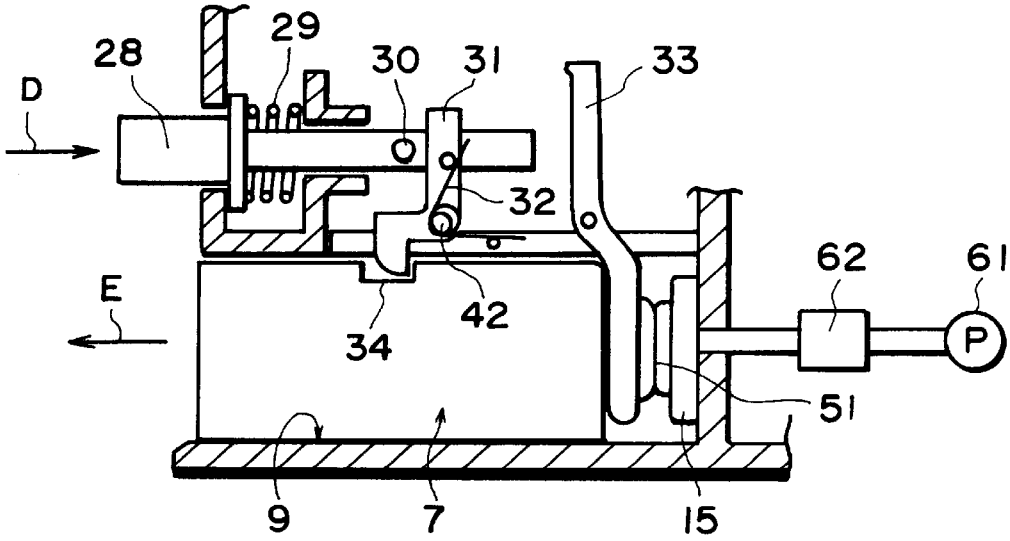
FIG. 14 is a sectional view of another embodiment of the mechanism for receiving or releasing the recording means, provided in the storing means of the ink jet recording apparatus in accordance with the present invention.

FIG. 13 is a schematic sectional view of a preferred embodiment of a mechanism provided in the storage space 9 for receiving or releasing the head cartridge 7 or 8. FIG. 14 is a schematic sectional view of another mechanism provided in the storage space 9 for receiving or releasing the head cartridge 7 or 8. Incidentally, FIGS. 13 and 14 depict how the head cartridge 7 is inserted or removed. The insertion and removal of the head cartridge 8 is no different from this case.

In FIG. 13, a reference numeral 23 designates a projection provided on the head cartridge 7 for retaining the head cartridge in place; 24, a leaf spring provided on the main assembly side of the apparatus, to be engaged with the projection 23 of the head cartridge 7; and a reference 25 designates a rib provided at a location (location in the storage space 9) where the rib does not come in contact with ink ejection surface 51 during the insertion of the head cartridge 7. The head cartridge 7 in the storage space 9 (illustrated by the solid line) can be taken out by pulling the head cartridge 7 down in a circular motion as indicated by an arrow B against the spring pressure of the leaf spring 24, and then, pulling up in an arrow C direction after the engagement between the projection 23 and leaf spring 24 is broken.

On the other hand, when the head cartridge 7 is to be inserted in the storage space 9, the aforementioned steps for taking out are reversed. In other words, the head cartridge 7 is inserted in the direction opposite to the one indicated by the arrow C, in a manner so that the surface of the head cartridge 7, other than the ejection surface 51, comes in contact with the rib 50, and then, the head cartridge 7 is rotated in the direction opposite to the one indicated by the arrow B against the spring force of the leaf spring 24 until the projection 23 engages with the leaf spring 24, whereby the head cartridge 7 is properly positioned in the storage space 9 in a predetermined manner. Also in this embodiment, the cap may be provided with the pump 61 and waste ink container 62.

In FIG. 14 showing another mechanism for receiving or releasing the head cartridge, a reference numeral 28 designates an ejector lever for ejecting the head cartridge 7; 29, a return spring for providing a force to hold the ejector lever 28 at a location shown in the drawing; 30, a projection (pin) provided on the ejector lever 28 for breaking the engagement; 31, a retaining lever pivoted by a fulcrum 42 provided on the main assembly side of the apparatus; 32, a leaf spring for providing the retaining lever 31 with a force to retain the head cartridge 7 at a predetermined retaining position; 33, a pusher lever pivoted on the main assembly side of the apparatus for pushing out the head cartridge 7; and a reference numeral 34 designates an engagement notch (recess) provided on the head cartridge 7.

When it is necessary to take out the head cartridge 7 stored in a manner as shown in FIG. 14, the ejector lever 28 is pushed in the direction indicated by an arrow D. As the ejector lever 28 is pushed in the arrow D direction, the projection 30 pushes the retaining lever 31, whereby the retaining lever 31 is moved out of the engagement notch (recess) of the head cartridge 7, freeing thereby the head cartridge 7. As the ejector lever 28 is pushed further in the arrow D direction, the leading tip of the ejector lever 28 contacts the pusher lever 33, pivoting the pusher lever 33 in the counterclockwise direction in the drawing, whereby the head cartridge 7 is pushed out in the direction indicated by an arrow E (outward) to be taken out.

Normally, the ejector lever 28 is held by the return spring 29 in a manner as shown in the drawing. When it is necessary to insert the head cartridge 7 into the storage space 9, all that is needed is to push the head cartridge 7 into the storage space 9. As the head cartridge 7 is pushed in, the steps for taking out are carried out in reverse to position the head cartridge 7 at the predetermined location. Incidentally, the head cartridge 7 may be inserted into the storage space 7 while the ejector lever 28 is held in to retract the retaining lever 31. Also in this embodiment, the pump 61 and waste ink container 62 may be provided as they are in the preceding embodiments, except that the waste ink container is constructed as a substantially sealed system, and is interposed between the cap and the pump 61. In this case, the pump on the main assembly side of the apparatus may double as the pump 61.

In the aforementioned embodiments, a single storage space 9 is provided. However, two or more storage spaces 9 having the same structure may be provided to match the number of head cartridges incorporated in the apparatus. Further, the location of the storage space 9 on the recording apparatus may be freely selected, and also, the inserting direction may be freely chosen, for example, vertical, horizontal (side to side, back and forth), or diagonal.

As for the head cartridge, it may be of a mono-color type or of a multi-color type, wherein the apparatus may incorporate a single head cartridge or two or more head cartridges, which may be used with one ink having one of various colors such as black, yellow, cyan, magenta, or green, having one of various densities of the same color; or having one of different compositions, or which may be used with combinations of such inks as listed above.

Further, according to the embodiments described hereinbefore, the head cartridge is of the type in which the recording head and the ink container are integrated. However, the head cartridge may be of a type in which the recording means (recording head) and the ink container may be independent from each other.

According to each of the embodiments described hereinbefore, the ink jet recording apparatus comprises the storage space 9 where the recording means not in use is stored, wherein this storage space 9 comprises the capping means 20 and 21 for sealing the ejection orifices 52 of the head cartridge (recording means) 7 or 8, and the performance recovering means, which are the pump 61 and the waste ink container 62. Therefore, it is assured that the ink ejecting portion of the recording means is well protected and its performance is recovered, eliminating the inconveniences such as the ink drying and solidifying to adhere within the ejection orifices 52; foreign matter or bubbles entering the ejection orifices 52; or foreign matter such as dust adhering to the ejection surfaces 51. As a result, poor ink ejection or a shifting of the direction in which the ink is ejected, is prevented, and therefore, deterioration of the quality of the recorded image is prevented. In other words, according to the present invention, a highly reliable ink jet recording apparatus can be embodied.

Further, since the head cartridge not in use is stored in the main assembly of the apparatus, there is little chance that the recording means is carelessly dropped by the user, and therefore, the foaming of the ink caused by dropping is prevented, whereby the recording means is prevented from being damaged by static electricity while left out.

In the embodiments described hereinbefore, the recording apparatus is of a serial type and the recording means 7 or 8 is mounted on the carriage 6. However, the present invention may be applied in the same manner to a recording apparatus of a line type in which a recording means of a line type capable of covering the entire or a portion of the recording width the recording material 2 is to record the image by scanning the recording material 2 only in the secondary direction, and the same results can be obtained. Further, with regards the recording means 7 or 8, the present invention is applicable to recording means having a different structure, in addition to the cartridge type in which the ink ejecting portion (recording head) and the ink container are integrated. For example, the ejection portion (recording head) and the ink container may be independent units which are connected through an ink supply tube or the like. In other words, the same results can be obtained regardless of the structure of the recording means.

However, the above described structure in which the cartridge is simply dropped into the storage space 9 provided in the apparatus has such a problem that the head surface is liable to be damaged by an impact when the cartridge is dropped into the storage space 9. This problem can be solved by providing a cartridge case. When the cartridge is to be inserted into the apparatus, it is first placed in the cartridge case, and then, the cartridge case containing the cartridge is inserted in the storage space 9 of the apparatus.

Figure 15:
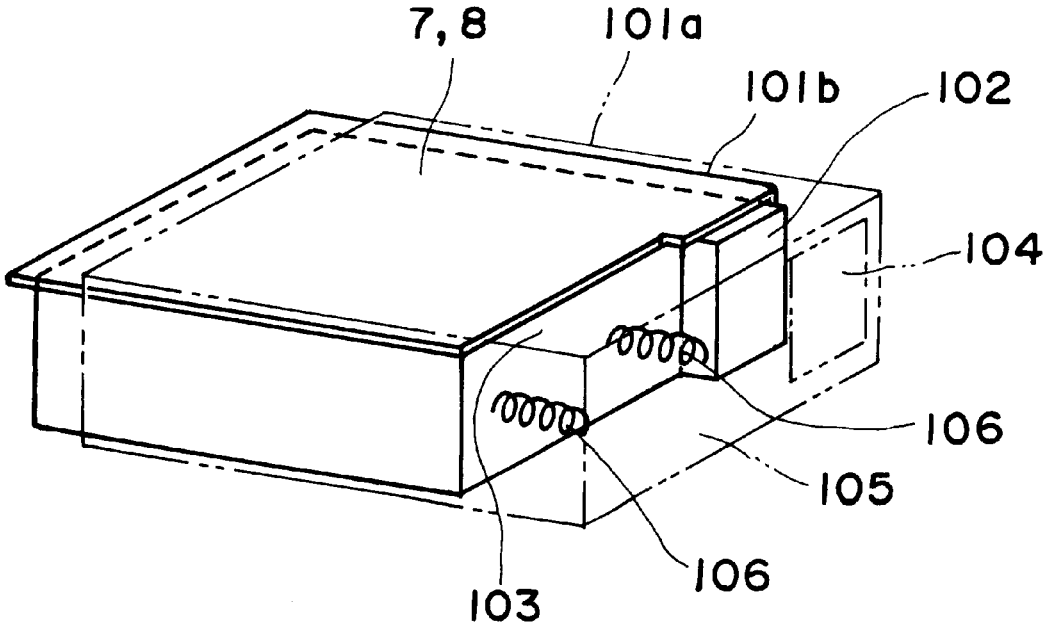
FIG. 15 is a perspective view of a recording means case inserted into the storing means while containing the recording means.

An embodiment of such a case is described hereinafter. Referring to FIG. 15, the cartridge case comprises an external shell 101*a* and an internal shell 10*b*, and the internal shell 101*b* comprises a plate 103 having an opening 102 which accommodates the recording head of the cartridge.

Also, the external shell 101*a* is provided with an opening 104, on a plate 105, to accommodate the recording head. The internal shell 101*b* is slidable within the external shell 101*a*, wherein springs 106 are provided between the plates 103 and 105, keeping both plates apart in a normal condition. The cartridge is inserted into the internal shell 101*b*, and then, the entire case containing the cartridge is inserted into the storage space 9 of the apparatus. As the bottom portion of the internal shell 101*b* is further pushed in, the head portion of the cartridge moves toward the cap provided in the storage space 9, against the resilient force of the spring 106, until the head portion comes in contact with the cap, and at this time, the internal shell 101b and the external shell 101*a* are locked together, with the head being capped, by the structure as shown in FIG. 14. When it is necessary to take out the cartridge, all that is needed is to release the locking. As the locking is released, the internal shell 101*b* is ejected partially out by the spring 6, and then, the entire case is pulled out by grasping this partially ejected portion.

As is evident from the above descriptions, according to an aspect of the present invention, an ink jet recording apparatus comprising a recording means which records images by ejecting ink onto a recording material further comprises a storing means for storing a recording means not in use, wherein a capping means is provided in the storing means for capping the ejection orifices of the recording means, whereby the recording means not in use can be surely protected, and also, when the stored recording means is reused, an excellent image can be produced.

According to other aspects of the present invention, in addition to the aforementioned structures, the capping means comprises an ink absorbing member, or the storing means comprises a guiding means for regulating the attitude of the recording means when the recording means is inserted into the storing means; covering means provided at the opening of the storing means for sealing the opening; retaining means for retaining the recording means; or releasing means for releasing the retaining means. Therefore, the recording means not in use can be more efficiently inserted into or taken out from the storing means, where it is more surely protected, and when the stored recording means is reused, an excellent image can be recorded.

Further, the provision of the cartridge case can eliminate the inconvenience which may occur when the cartridge is inserted in the storing means, assuring further that the cartridge is safely stored.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording apparatus usable with a plurality of ink jet cartridges, each having an ink ejection outlet, said apparatus comprising:

a scanningly movable carriage to which one of said plurality of ink jet cartridges being used for a current recording operation is detachably mountable;

an ink jet cartridge accommodating portion, separate from said movable carriage, for accommodating one of said plurality of ink jet cartridges not being used for the current recording operation; and a plurality of caps, in said accommodating portion, for capping the ejection outlet of the one of said plurality of ink jet cartridges not used for the current recording operation, wherein said accommodating portion has an opening shaped to commonly receive any one of said plurality of ink jet cartridges when not being used for the current recording operation, and the opening is shaped such that one of the plurality of ink jet cartridges is commonly receivable in the opening in only a first orientation and another one of the plurality of ink jet cartridges is commonly receivable in the opening in only a second orientation, and such that, when received, the ejection outlet of each one of said plurality of ink jet cartridges is aligned with a predetermined one of said plurality of caps.

2. An ink jet recording apparatus according to claim 1, wherein the opening of said accommodating portion comprises guiding means for regulating a position of the one of said plurality of ink jet cartridges not used for the current recording operation.

3. An ink jet recording apparatus according to claim 1, wherein said accommodating portion comprises covering means provided at the opening of said accommodating portion for sealing the opening.

4. An ink jet recording apparatus according to claim 1, wherein said accommodating portion comprises retaining means for retaining the one of said plurality of ink jet cartridges not used for the current recording operation.

5. An ink jet recording apparatus according to claim 4, wherein said accommodating portion comprises releasing means for releasing said retaining means.

6. An ink jet recording apparatus according to claim 1, wherein each of said ink let cartridges comprises an electrothermal transducer for generating thermal energy used to eject ink.

7. An ink jet recording apparatus according to claim 6, wherein each of said ink jet cartridges causes film boiling in the ink by way of the thermal energy which said electrothermal transducer generates, to eject the ink from the ejection outlet.

8. An ink jet recording apparatus according to claim 1, wherein said accommodating portion comprises casing means for casing said one of said plurality of ink jet cartridges not used for the current recording operation.

9. An ink jet recording apparatus according to claim 1, wherein said cap comprises a suction pump for discharging the ink from said one of said plurality of ink jet cartridges not used for the current recording operation, and a waste ink container for storing discharged waste ink.

10. An ink jet recording apparatus according to claim 1, wherein said ink jet cartridge accommodating portion is detachably mountable to said ink jet recording apparatus.

11. An ink jet recording apparatus according to claim 1, wherein the opening of said accommodating portion has a protrusion formed on the periphery of the opening.

12. An apparatus according to claim 1, wherein the opening is rectangular and the ejection outlet of a plurality of said plurality of ink jet cartridges is alignable with any one of said plurality of caps.

13. An ink jet cartridge accommodating device for accommodating a plurality of ink jet cartridges, each having an ink ejection outlet, said device comprising:

an ink jet cartridge accommodating portion for accommodating one of said plurality of ink jet cartridges not being used; and a plurality of caps, in said accommodating portion, for capping the ejection outlet of the one of said plurality of ink jet cartridges not being used, wherein said accommodating portion has an opening shaped to commonly receive any one of said plurality of ink jet cartridges when not being used, and the opening is shaped such that one of the plurality of ink jet cartridges is commonly receivable in the opening in only a first orientation and another one of the plurality of ink jet cartridges is commonly receivable in the opening in only a second orientation, and such that, when received, the ejection outlet of each one of said plurality of ink jet cartridges is aligned with a predetermined one of said plurality of caps.

14. An ink jet cartridge accommodating device according to claim 13, wherein the opening of said accommodating portion comprises guiding means for regulating a position of the one of said plurality of ink jet cartridges not used for the current recording operation.

15. An ink jet cartridge accommodating device according to claim 13, wherein said accommodating portion comprises covering means provided at the opening of said accommodating portion for sealing the opening.

16. An ink jet cartridge accommodating device according to claim 13, wherein said accommodating portion comprises retaining means for retaining the one of said plurality of ink jet cartridges not used for the current recording operation.

17. An ink jet cartridge accommodating device according to claim 16, wherein said accommodating portion comprises releasing means for releasing said retaining means.

18. An ink jet cartridge accommodating device according to claim 13, wherein each of said ink jet cartridges comprises an electro-thermal transducer for generating thermal energy used to eject ink.

19. An ink jet cartridge accommodating device according to claim 18, wherein each of said ink jet cartridges causes film boiling in the ink by way of the thermal energy which said electro-thermal transducer generates, to eject the ink from the ejection outlet.

20. An ink jet cartridge accommodating device according to claim 13, wherein said accommodating portion comprises casing means for casing said one of said plurality of ink jet cartridges not used for the current recording operation.

21. An ink jet cartridge accommodating device according to claim 13, wherein said cap comprises a suction pump for discharging the ink from said one of said plurality of ink jet cartridges not used for the current recording operation, and a waste ink container for storing discharged waste ink.

22. An ink jet cartridge accommodating device according to claim 13, wherein said ink jet cartridge accommodating portion is detachably mountable to said ink jet recording apparatus.

23. An ink jet cartridge accommodating device according to claim 13, wherein the opening of said accommodating portion has a protrusion formed on the periphery of the opening.

24. An ink jet cartridge accommodating device according to claim 13, wherein the opening is rectangular and the ejection outlet of a plurality of said plurality of ink jet cartridges is alignable with any one of said plurality of caps.

* * * * *

UNITED STATES PATENT AND TRADEMARK OFFICE

CERTIFICATE OF CORRECTION

PATENT NO. : 6,170,945 B1
DATED : January 9, 2001
INVENTOR(S) : Matsui et al.

It is certified that error appears in the above-identified patent and that said Letters Patent is hereby corrected as shown below:

Column 3,
Line 11, "an" should read -- a --.

Column 5,
Line 50, "embodiments" should read -- embodiment --.

Column 7,
Line 3, "rib 50," should read -- rib 25, --.

Column 10,
Line 29, "let" should read -- jet --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*